United States Patent [19]

Perkins

[11] Patent Number: 4,779,575

[45] Date of Patent: Oct. 25, 1988

[54] LIQUID FRICTION HEATING APPARATUS

[76] Inventor: Eugene W. Perkins, Route 1, Box 1399, Dawsonville, Ga. 30534

[21] Appl. No.: 81,311

[22] Filed: Aug. 4, 1987

[51] Int. Cl.[4] ..... F22B 3/06

[52] U.S. Cl. ..... 122/26; 126/247; 415/71; 415/120; 415/143; 415/206

[58] Field of Search ..... 122/11, 12, 26; 126/247; 237/1 R; 415/198.1, 206, 143, 120, 71; 165/90

[56] References Cited

U.S. PATENT DOCUMENTS

| | | | |
|---|---|---|---|
| 3,242,908 | 3/1966 | Kopczynski | 122/11 |
| 3,933,007 | 1/1976 | Eskeli | 126/247 X |
| 3,937,034 | 2/1976 | Eskeli | 126/247 X |
| 4,003,672 | 1/1977 | Gamell | 415/71 |
| 4,381,762 | 5/1983 | Ernst | 122/26 X |
| 4,480,592 | 11/1984 | Gokcen | 126/247 X |
| 4,664,068 | 5/1987 | Kretchmar et al. | 126/247 X |

*Primary Examiner*—Steven E. Warner

*Attorney, Agent, or Firm*—Scrivener and Clarke

[57] ABSTRACT

Liquid friction heating apparatus includes a pump rotor and an impeller rotor in a liquid reservoir. As the pump and impeller are rotated they impart frictional heat to the liquid. Further, the pump at all times delivers liquid to the inlet of the impeller which impells the liquid through restricted orifices to further heat the liquid. The pump positively prevents cavitation and ensures a constant flow through the orifices.

8 Claims, 1 Drawing Sheet

LIQUID FRICTION HEATING APPARATUS

FIELD OF THE INVENTION

This invention relates to apparatus for heating liquid and more particularly to apparatus for heating liquid by internal friction.

BACKGROUND OF THE INVENTION

It is well known to heat liquid by internal friction either by rotating a body in a liquid reservoir as disclosed, for example, in my U.S. Pat. No. 4,424,797 or by forcing liquid through restricted orifices as disclosed in the patent to Horne et al. U.S. Pat. No. 4,344,567. Though rotating a body through liquid in a reservoir is effective to heat the liquid a problem of cavitation can arise where the rotor loses intimate contact with the liquid, and during such periods the heating process becomes highly inefficient.

SUMMARY OF THE INVENTION

The broad object of the invention is to vastly improve the efficiency of a friction heater for liquids by not only rotating a cylindrical heating rotor in the liquid, but also by constructing the rotor as a liquid impeller wherein a central cavity is provided in the rotor with fluid passages interconnecting the central cavity and the periphery of the rotor, the passages being so arranged relative to the rotational axis of the rotor that fluid is expelled with great centrifugal force through the passages, each passage having adjacent its outlet end a restricted orifice. As the liquid is expelled through the orifices, it is heated due to the frictional constriction of the liquid by the orifices. In addition, the liquid in the reservoir has a measure of heat imparted thereto by the frictional engagement of the liquid with all of the external surfaces of the rotor. To further increase the efficiency of the heater and in accordance with the invention I provide pump means which delivers pressurized liquid from the reservoir directly to the central cavity whereby cavitation in the cavity is entirely eliminated and liquid is forced through the restricted orifices not only by centrifugal force but also by the pressure on the liquid delivered by the pump to the cavity. Though any of a variety of pump means would fall within the purview of the invention, desirably the pump is a rotor generally similar to the described heating rotor but substantially reversed whereby as the pump rotor rotates it scoops liquid into the fluid passages, which are arranged relative to the axis of rotation that the liquid flows inwardly to a central cavity which is directly connected by conduit means to the central cavity of the heating rotor. The advantage of providing a rotary pump of the type described is that it, too, as it rotates imparts heat to the liquid wherever the latter is in frictional contact with the pump rotor.

DETAILED DESCRIPTION OF THE INVENTION

Figure 1:
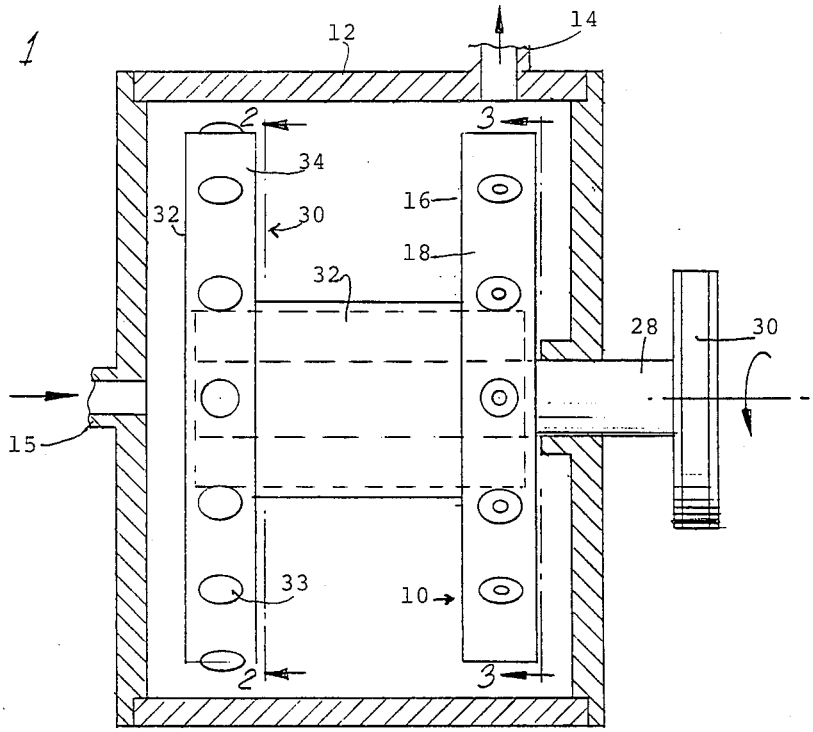
FIG. 1 is a vertical cross-sectional view of apparatus for frictionally heating liquid in accordance with the invention.

Referring now to the drawings the numeral 10 designates an impeller constructed in accordance with the invention. The impeller 10 is disposed within a closed housing 12 defining a reservoir containing a suitable heat transfer liquid. The housing 12 has an outlet port 14 and an inlet port 15 connected to the inlet and outlet, respectively, of a suitable heat utilization device (not shown) such as a heat exchanger.

The impeller 10 comprises a cylindrical rotor 16 having a peripheral surface 18 and a central inlet cavity 20. Fluid passages 22 lead from the inlet cavity to the peripheral surface 18 of the rotor, the passages 22 being arranged relative to the axis of rotation of the rotor 16 that upon rotation thereof in a predetermined direction, as indicated by the arrow 24, liquid is impelled by centrifugal force to flow from the inlet cavity 20, through the passages 22 outwardly of the rotor. Restricted orifices 26 are provided in the fluid passages, preferably at their outer extremities where the velocity of the liquid is at a maximum, to cause the liquid to become heated as it is impelled through the orifices. The orifice 26 may be provided in inserts 28 and if there is danger of erosion of the rotor, should it be of a light metal such as aluminum, there may be provided additional inserts at the inner ends of the passages 22 or, for that matter, throughout the lengths of the passages, any and all inserts being made of a substance, such as steel, having a predetermined hardness capable of resisting erosion.

Means, such as the shaft 28 and drive pulley 30, are provided for rotating the impeller rotor 16 and, in accordance with the invention pump means, broadly designated by the numeral 30, delivers liquid from the housing 12 directly to the inlet cavity 20 of the impeller rotor 16 at all times while the latter is rotated in the predetermined direction 24. As is apparent,thecavity 20 and the peripheral surface 18 are co-axial and a conduit 32 is co-axial with the inlet cavity 20, the pump means 30 being disposed to induce pressurized axial liquid flow through the conduit 32 into the cavity 20.

As shown, the shaft 28 extends into the housing 12 in cantilever fashion with the inlet port 15 being axially aligned with the shaft. This is the arrangement of a prototype. Obviously, the shaft could extend to a bearing in the left hand wall of the housing 12 as viewed in FIG. 1 and the inlet port could be located elsewhere in that wall. Regardless, the pump means 30 is shown secured to the shaft 28 with the pump means having inlet means, hereafter described in detail, open to the liquid in the housing 12 and an outlet connected to the fluid conduit 32.

Figure 2:
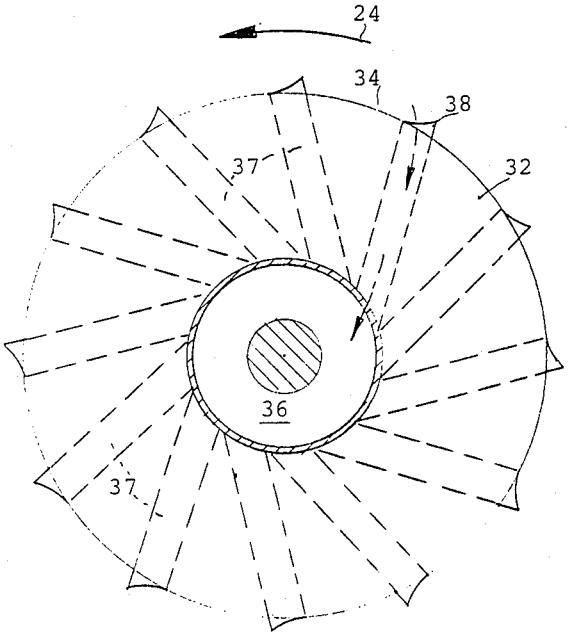
FIG. 2 is a vertical cross-sectional view of a rotary pump looking in the direction of the arrows 2—2 in FIG. 1.
Figure 3:
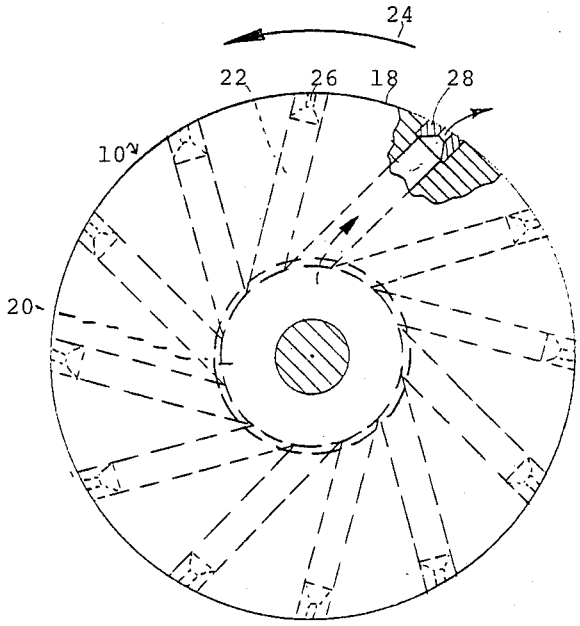
FIG. 3 is a vertical cross-sectional view of the rotary heating impeller of the invention looking in the direction of the arrows 3—3 of FIG. 1.

The pump means 30 comprises a rotor 32 which may be substantially similar to the impeller rotor 16 though reversed. The pump rotor has a peripheral surface 34, a central outlet cavity 36 and fluid passages 37 leading from the peripheral surface to the outlet cavity and arranged relative to the axis of rotation of the rotor that upon rotation thereof in the same predetermined direction 24, fluid is forced to flow from the periphery of the rotor into the outlet cavity 36. In order to positively induce flow into the passages 37 the ends thereof are provided with suitable scoops 38 as seen in FIG. 2. The fluid conduit means 32 comprises a cylindrical member rigidly connected to the respective pump and impeller rotors 32, 16 for rotation therewith in axial alignment with the outlet and inlet cavities 36, 20.

The operation of the apparatus should be clear from the foregoing description. The pump and impeller are driven in a closed system, and as the two rotors rotate, they heat liquid in frictional contact with their exposed surfaces. In addition, the pump delivers liquid under pressure to the inlet cavity of the impeller from which the liquid is impelled through the passages 22 having restricted orifices 28 therein where the liquid is further heated. Due to the pumping action of the pump which positively delivers liquid under pressure to the inlet cavity of the impeller rotor 16, it is impossible for the inlet cavity to cavitate and thus liquid is at all times subjected to heating effects with substantially no loss in efficiency as can occur where a rotor is simply rotated in a body of liquid. The combined pumping action of the pump 30 and impeller 10 is highly adequate to ensure radial flow through the outlet port 14, and the device being served, such as a heat exchanger, and back to the inlet port 15.

It will be apparent that the invention is susceptible of a variety of modifications and changes without, however departing from the scope and spirit of the appended claims.

What is claimed is:

1. Apparatus for heating liquid comprising:

a. an enclosed housing defining a reservoir containing a heat transfer liquid;

b. an impeller disposed within said housing said impeller comprising:

i. a cylindrical rotor having an external surface including a peripheral surface said surfaces being in frictional engagement with the liquid in said housing;

ii. a central inlet cavity in said rotor;

iii. fluid passages leading from said inlet cavity to the peripheral surface of the rotor; said passages being arranged relative to the axis of rotation of said rotor that upon rotation thereof in a predetermined direction liquid is impelled by centrifugal force to flow from said inlet cavity through said passages outwardly of said rotor; and iv. restricted orifices in said fluid passages to cause liquid to become frictionally heated as it is impelled through said orifices;

c. means for rotating said rotor within said liquid in said housing in said predetermined direction; and d. pump means for delivering liquid from said housing directly to said central inlet cavity of said rotor at all times while said rotor is rotated in said predetermined direction.

2. The apparatus of claim 1, wherein the restricted orifices are located proximate the outer ends of said fluid passages.

3. The apparatus of claim 1, wherein said central inlet cavity and said peripheral surface are co-axial, and a fluid conduit is co-axial with said inlet cavity, said pump means being disposed to induce pressurized liquid flow from said housing through said conduit into said central cavity.

4. The apparatus of claim 3, wherein said impeller is secured to a rotatable shaft and said pump means comprises a pumping unit secured to said shaft and having inlet means open to the liquid in said housing and an outlet connected to said fluid conduit.

5. The apparatus of claim 4, including an outlet port in said housing proximate said impeller and an inlet port in said housing proximate said pump means.

6. The apparatus of claim 1, wherein said pump means and said impeller are mounted on a common shaft in said housing for simultaneous operation by said rotating means a. said pump means comprising:

i. a rotor within said housing and having an external surface including a peripheral surface, said surfaces being in frictional engagement with the liquid in said housing;

ii. a central outlet cavity;

iii. fluid passages leading from said peripheral surface to said outlet cavity; said passages being arranged relative to the axis of rotation of said rotor that upon rotation thereof in said predetermined direction fluid is forced to flow from the periphery of said rotor into said outlet cavity;

b. and fluid conduit means directly connecting said outlet and inlet cavities.

7. The apparatus of claim 6, wherein said fluid conduit means comprises a cylindrical member co-axially and rigidly connected to the respective rotors of said pump and said impeller for rotation therewith and in co-axial alignment with said outlet and inlet chambers.

8. The apparatus of claim 6, including scoops at the outer end of said fluid passages in said pump rotor to induce fluid flow into said passages.

* * * * *